US005352035A

United States Patent [19]

Macaulay et al.

[11] Patent Number: 5,352,035

[45] Date of Patent: Oct. 4, 1994

[54] CONCRETE MIXING SYSTEM WITH CEMENT/WATER PREMIXER

[75] Inventors: Donald J. Macaulay, Sherwood, Oreg.; David S. Lofts, Vancouver, Wash.

[73] Assignee: Hydromix, Inc., Tualatin, Oreg.

[21] Appl. No.: 36,192

[22] Filed: Mar. 23, 1993

[51] Int. Cl.[5] ..... B28C 5/14; B28C 5/34; B28C 7/04; B01F 7/08

[52] U.S. Cl. ..... 366/15; 366/38; 366/50; 366/172; 366/186; 366/298; 366/321

[58] Field of Search ..... 366/14, 15, 20, 33–35, 366/38, 40, 50, 64, 66, 168, 172, 177, 186, 192, 193, 194–196, 297–300, 318, 321

[56] References Cited

U.S. PATENT DOCUMENTS

| | | | |
|---|---|---|---|
| 1,013,612 | 1/1912 | Peters | 366/300 X |
| 1,753,716 | 4/1930 | Owen . | |
| 2,486,323 | 10/1949 | Raypholtz . | |
| 3,006,615 | 10/1961 | Mason, Jr. | 366/20 |
| 3,591,145 | 7/1971 | Ainsworth et al. | 366/300 X |
| 3,702,691 | 11/1972 | Fritsch | 366/298 X |
| 4,117,547 | 9/1978 | Mathis et al. | 366/50 X |
| 4,586,824 | 5/1986 | Haws . | |
| 4,624,574 | 11/1986 | Mills et al. | 366/318 X |
| 4,830,505 | 5/1989 | Dunton et al. . | |
| 4,904,089 | 2/1990 | Dunton et al. . | |
| 5,100,239 | 3/1992 | Ono et al. . | |

FOREIGN PATENT DOCUMENTS

| | | | |
|---|---|---|---|
| 2619810 | 11/1977 | Fed. Rep. of Germany | 366/33 |
| 55-111332 | 8/1980 | Japan | 366/40 |
| 3108510 | 5/1991 | Japan | 366/38 |
| 2098497 | 11/1982 | United Kingdom | 366/64 |

*Primary Examiner*—David A. Scherbel
*Assistant Examiner*—Charles Cooley
*Attorney, Agent, or Firm*—Chernoff, Vilhauer, McClung & Stenzel

[57] ABSTRACT

A system for mixing cementitious material, liquid and aggregate to form concrete includes a cementitious material measuring device which provides dry cementitious material to an enclosed screw conveyor assembly. The dry cementitious material is thoroughly mixed with a liquid within the screw conveyor to form a flowable slurry without producing external cement dust pollution. The slurry is output by the screw conveyor into a final product mixing chamber where the flowable slurry is mixed together with aggregate to form concrete. The screw conveyor assembly has an in-line input and output, and space-saving diverging/converging conveyor sections, to facilitate the retrofitting of existing concrete mixing plants. The conveyor assembly includes a cement metering function as well as a slurry mixing function. A selectively openable and closable bypass gate permits the dry cementitious material to be sent directly to the final product mixing chamber in the event of conveyor failure.

8 Claims, 4 Drawing Sheets

CONCRETE MIXING SYSTEM WITH CEMENT/WATER PREMIXER

BACKGROUND OF THE INVENTION

This invention relates to a system for mixing cementitious material, liquid and aggregate to form concrete. More particularly, this invention relates to a compact and inexpensive apparatus whereby the cementitious material portion and liquid portion of concrete are precisely metered and thoroughly mixed to form a flowable slurry within an enclosed screw conveyor before being mixed together with aggregate (e.g. sand and gravel) in a final product mixing chamber. Because the cementitious material and liquid are fully enclosed during the flowable slurry mixing step, the amount of airborne cementitious particulate matter, i.e. "dust," that is usually attendant in such mixing operations is greatly reduced. The need to apply copious quantities of water to wash the dust off the equipment and other surfaces in the mixing area is also proportionately reduced. Moreover, the time required to mix a given quantity of concrete is likewise reduced using this apparatus, which results in more efficient equipment utilization and greater output.

Increasingly strict local, state and federal pollution regulations have become an onerous burden to the operators of concrete mixing plants, particularly small mixing plant operators. Limits on airborne particulates and groundwater runoff and contamination require expensive modifications to existing concrete mixing plant equipment and operating procedures. New equipment that has become available only incidentally addresses these problems, and is complex and generally unsuitable for an existing mixing plant retrofit.

In addition to the need to reduce airborne particulates and groundwater runoff and contamination, there is an increased awareness that water is a very finite resource that needs to be conserved. While water is a minor component in the concrete mixture per se, it is a major component in the cleanup process for the concrete mixing area.

In addition, there are potential quality control issues that can arise when a specific concrete mixture requires a precise ratio of materials. Materials that are carefully measured should also be added together in a precise metered manner and thoroughly mixed to produce complete hydration. Obviously, when a portion of the cement that has been carefully measured according to a ratio for inclusion in a mixture is lost as airborne particulate, the characteristics of the final concrete mixture are altered. Likewise, mixing equipment that relies primarily on gravity to dispense and meter cement can easily clog, resulting in uneven metering, mixing, and an inferior end product.

Prior art improvements in the field of concrete mixing apparatus have generally been either technically complex attempts to solve particular problems affecting the very specific needs of small segments of the industry, or attempts to increase overall efficiency.

Ono et al. U.S. Pat. No. 5,100,239 discloses a method to produce concrete for mass concrete members by spraying liquid nitrogen onto aggregate (particularly sand) within enclosed conveyor screws prior to combining the nitrogen cooled aggregate with cement, water, and coarser aggregates for the final mixing operation. Ono does not recognize nor address the need to control cement dust pollution in a concrete mixing system by providing an inexpensive retrofittable apparatus.

Raypholtz U.S. Pat. No. 2,486,323 discloses a complicated variable output mixing system for mixing aggregate and bituminous material that operates similar to a pugmill without recognition of the foregoing pollution problem.

Owen U.S. Pat. No. 1,753,716 discloses a screw conveyor mixer particularly suited to producing a grout mixture for cementing oil wells. Owen does not provide nor suggest a final product mixing chamber for mixing a flowable cement slurry with aggregate to form concrete, nor recognize the foregoing pollution problem.

Haws U.S. Pat. No. 4,586,824 discloses a mobile concrete mixing apparatus wherein a conveyor initially carries aggregate from a storage bin. Dry cement is dumped on top of this aggregate as it travels on the conveyor, and water is sprayed on the aggregate and dry cement as it is dumped into a feed screw for mixing. Nothing in the system prevents cement dust pollution.

Dunton et al. U.S. Pat. Nos. 4,904,089 and 4,830,505 disclose a method of mixing particulate cement and water in a primary mixing vessel to form a slurry and delivering the slurry to an auxiliary mixing vessel for mixing with aggregate. The method and apparatus disclosed in Dunton '505 and '089 illustrates the recognized desirability and advantages produced by premixing concrete and liquid to form a slurry before mixing with aggregate. However, Dunton's solution is very complex and expensive, requiring the use of high velocity pumps and multiple rotary agitators to create the flowable slurry, and lacking easy retrofit adaptability to existing concrete mixing plants.

SUMMARY OF THE INVENTION

The present invention provides a system that enables a user to mix cementitious material, liquid, and aggregate material to produce a high quality final product while minimizing both polluting airborne particulates and the need to expend large quantities of water to wash particulates off of the mixing plant equipment and other surfaces, which creates ground water pollution and runoff problems. Mixing plant equipment can also be used more efficiently, decreasing the total time required to produce each batch of the final mixed product and resulting in increased plant output.

Whereas most prior concrete mixing plant operations have been little more than automated, high-volume versions of dumping a bag of cement in a container and stirring in water and aggregate, the present invention provides for the premixing of the cementitious material and liquid into a flowable slurry within a unique enclosed screw conveyor assembly. A screw conveyor rotates within a tubular housing assembly to thoroughly mix cementitious material, received through an enclosed inlet from a measuring device with a liquid to form the flowable slurry. The slurry is moved toward an outlet of the screw conveyor where it is deposited into a final mixing chamber and mixed with aggregate to form the final concrete product, all without the production of external cement dust.

The screw conveyor assembly is not only technically simple and inexpensive, but has a unique in-line inlet and outlet arrangement making it especially adaptable for easy retrofitting of existing concrete plants. The operator of a small mixing plant is able to incorporate the screw conveyor assembly directly between the plant's existing cementitious materials measuring device(s) and final produce mixing chamber(s).

Moreover, the conveyor assembly incorporates a unique diverging-converging pair of screw conveyors to limit its space requirements while maximizing its rate of production, thereby further increasing its easy adaptability to existing concrete mixing plants.

In addition, the conveyor assembly incorporates a cement metering function with its slurry mixing function, providing the plant with a much more accurate concrete mixing system.

The foregoing and other objectives, features, and advantages of the invention will be more readily understood upon consideration of the following detailed description of the invention, taken in conjunction with the accompanying drawings.

PREFERRED EMBODIMENT OF THE INVENTION

Figure 1:
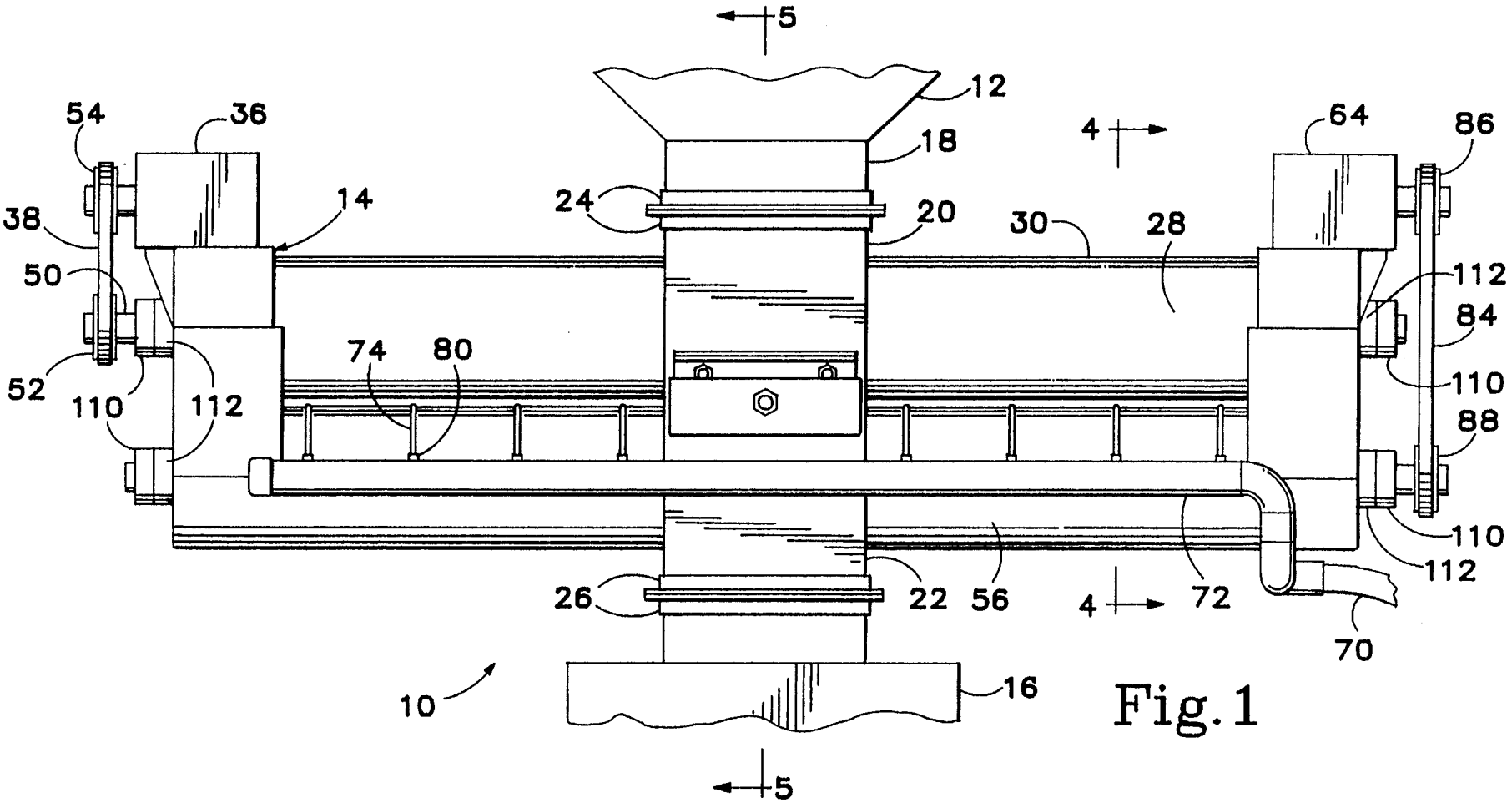
FIG. 1 is a side elevation view of a preferred embodiment of the apparatus of the present invention.
Figure 2:
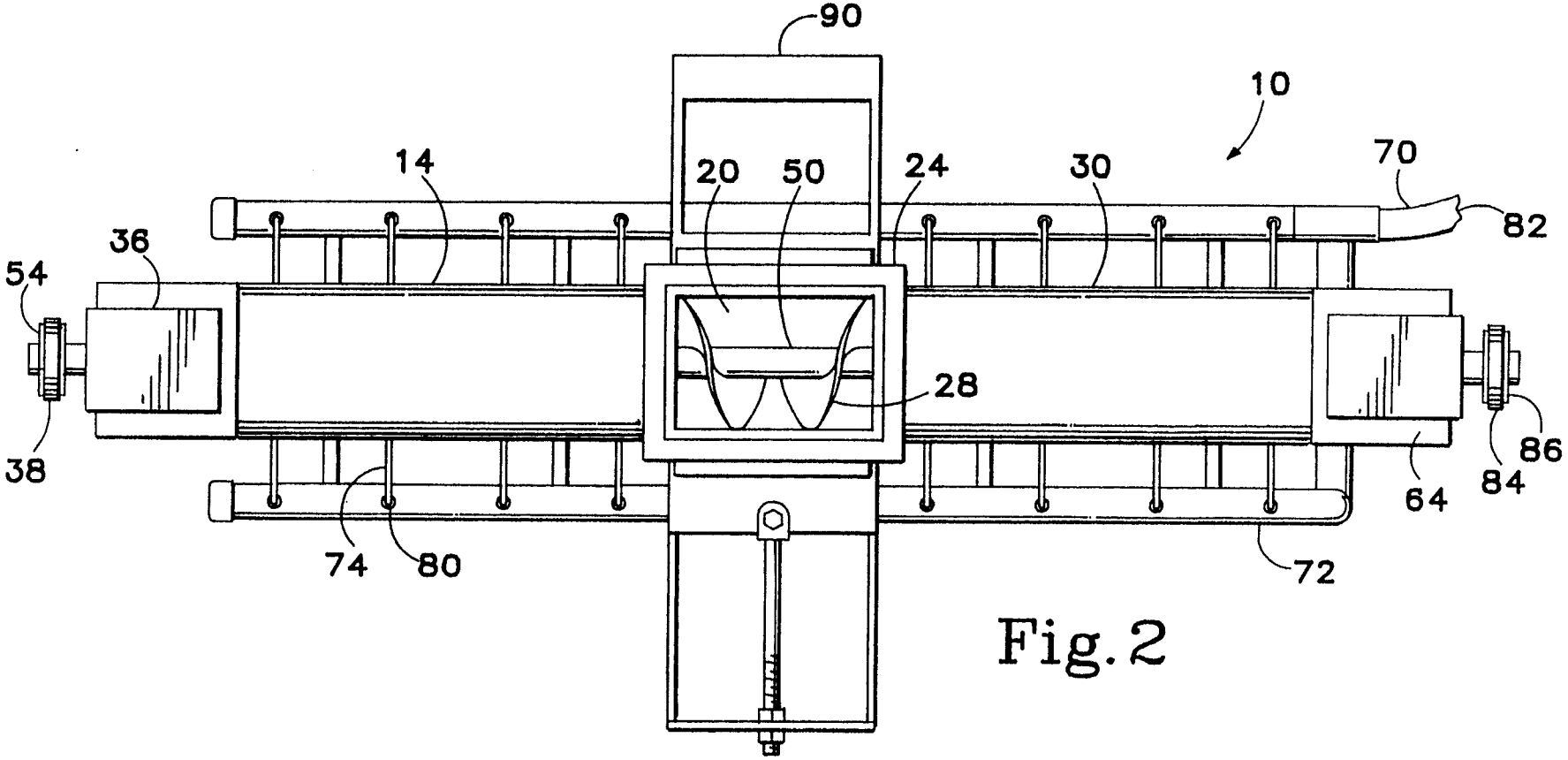
FIG. 2 is a top view of the apparatus of FIG. 1.
Figure 3:
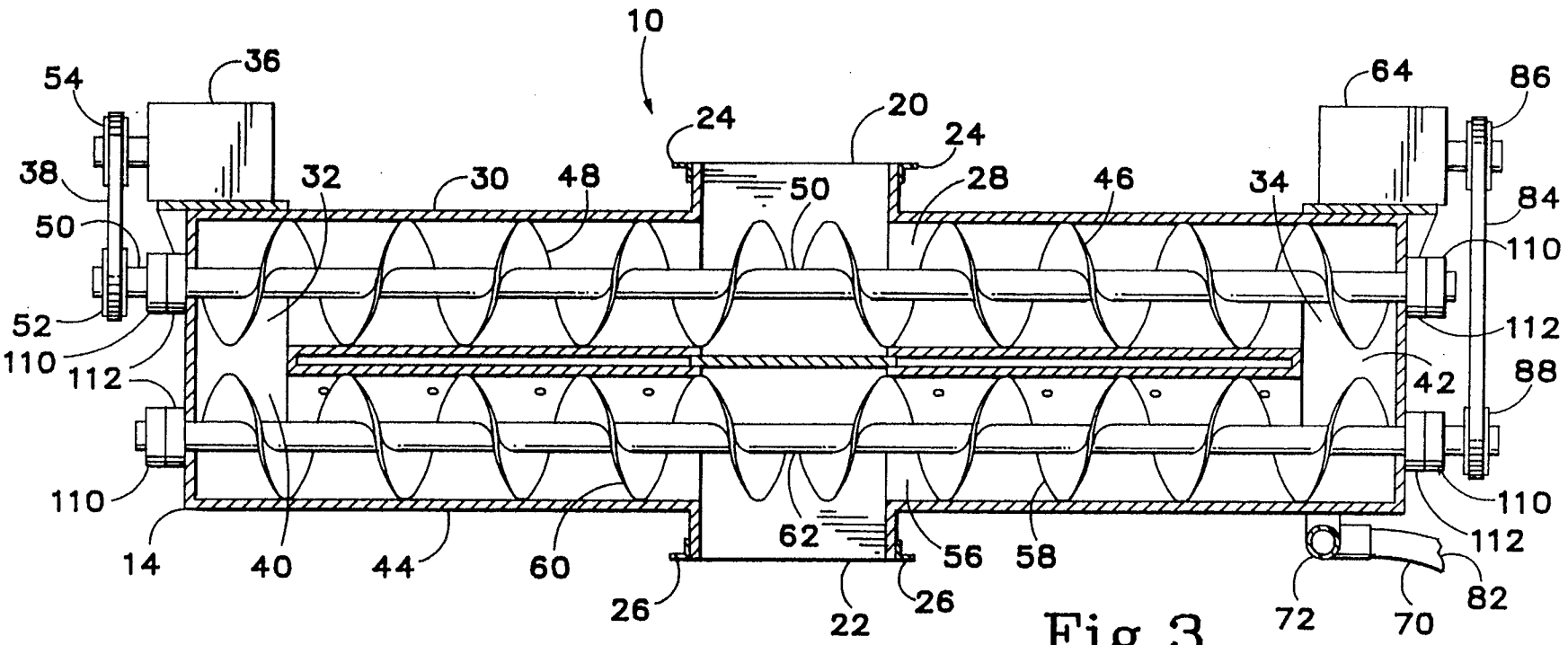
FIG. 3 is a side sectional view of the apparatus of FIG. 1.

With reference in particular to FIGS. 1-3, the exemplary apparatus 10 of the present invention is shown. At the outset it is important to note the relationship between the major subassemblies of the apparatus 10: the cementitious material measuring device 12, screw conveyor 14 and final product mixing chamber 16. In the exemplary apparatus the three major components are shown positioned in-line with each other.

The cementitious material measuring device 12 dispenses (by gravity or otherwise) a measured (by volume or weight) quantity of cementitious material, e.g. cement, fly ash, etc. The material outlet 18 of the measuring device 12 is in-line with the conveyor inlet 20, which feeds to a first conveyor screw assembly 28 of screw conveyor 14. The screw conveyor 14, which moves and mixes the cementitious material received from measuring device 12 with a liquid such as water to form a flowable slurry, has a conveyor outlet 22 in the bottom of a second conveyor screw assembly 56, the outlet 22 being positioned in-line with the inlet 20. Positioned below conveyor outlet 22 is the final product mixing chamber 16 where the flowable slurry emitted from conveyor outlet 22 is mixed together with a measured quantity of aggregate material (such as rock and sand) to form concrete.

In this exemplary apparatus 10 the dimensions of the screw conveyor 14 are such that it may be easily and inexpensively retrofitted between the device 12 and mixing chamber 16 already being used in most existing concrete mixing plants. Flanges 24 may be used to sealingly couple measuring device outlet 18 to the conveyor inlet 20. Depending on the particular final product mixing chamber 16 to be used, the conveyor outlet 22 may also be coupled to the top of the mixing chamber 16 by flanges 26. If the final product mixing chamber 16 is a mobile mixer, physical coupling may be unnecessary and the flowable slurry may "free-fall" from conveyor outlet 22 into final product mixing chamber 16 without the danger of any airborne particulate matter being emitted.

Dry cementitious material entering the conveyor inlet 20 of screw conveyor 14 from cementitious material measuring device 12 is moved by the rotation of the first conveyor screw assembly 28 enclosed within a first tubular housing 30. The dry cementitious material is moved in opposite diverging directions away from the conveyor inlet 20 and toward a first outlet 32 and a second outlet 34 located at opposite ends of the first tubular housing 30.

First conveyor screw assembly 28 has a pair of opposed single flight, standard pitch conveyor screws 46, 48 on a common shaft 50. Suitable conveyor screw assemblies are readily available from such manufacturers as Thomas Conveyor Co., Ft. Worth, Texas. In the exemplary apparatus conveyor screws having a diameter of approximately six inches have been found to be suitable.

First conveyor screw assembly 28 can be rotated by any suitable power source, here a hydraulic drive motor 36 shown coupled to common shaft 50 by a belt 38 and pulleys 52, 54. The rate of rotation of first conveyor screw assembly 28 should be variable to allow control over the rate that the dry cementitious material is moved. A hydraulic motor 36 of approximately 5 horsepower rotating at approximately 204 rpm has been found to work adequately. Flanged ball bearings 110 and shaft seals 112 are used with shaft 50.

When the dry cementitious material moved by the first conveyor screw assembly 28 reaches the first outlet 32 and the second outlet 34 located at the opposite ends of first tubular housing 30, the dry cementitious material falls by gravity through first outlet 32 and second outlet 34 into and through respective first and second inlets 40, 42 of the second tubular housing assembly 44 of the second conveyor screw assembly 56 positioned beneath and substantially parallel to the first tubular housing assembly 30. The second conveyor screw assembly 56 is a pair of opposed conveyor screws 58, 60 on a common shaft 62 which also has flanged ball bearings 110 and shaft seals 112. Unlike first conveyor screw assembly 28 which is designed simply to move the dry cementitious material away from the conveyor inlet 20 toward the first outlet 32 and second outlet 34 at a controlled, metered rate, the design and function of second conveyor screw assembly 56 is different. In the second conveyor screw assembly 56 the dry cementitious material must be thoroughly mixed with liquid to form a flowable slurry as it is simultaneously moved away from the first and second inlets 40, 42 at the opposite ends of the second tubular housing assembly 44 converging inward toward the conveyor outlet 22.

The design of a screw conveyor to mix material as it is being moved is well known in the art, and depending upon such variables as the particular cementitious material to be mixed and the power source(s) (motors 36, 64), the second conveyor screw assembly 56 could include paddles (not shown) to perform the mixing operation. There are also conveyor screws, well known in the art, of cut flight, cut and folded flight and multiple ribbon flight design that could be used to move and mix the materials.

Figure 4:
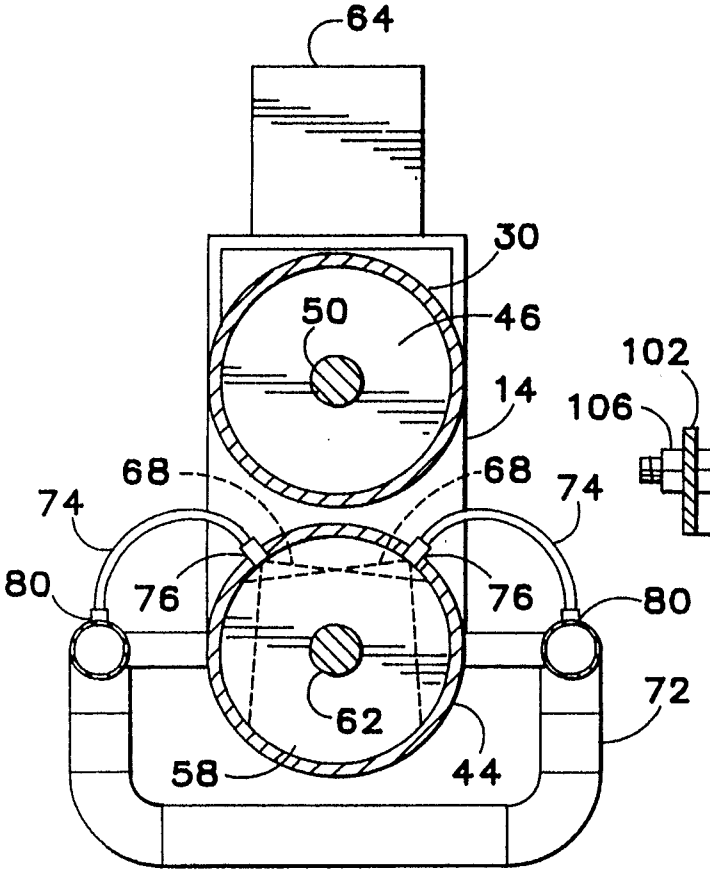
FIG. 4 is a cross-sectional view taken along line 4-4 of FIG. 1.

The liquid, generally water, necessary to create the flowable slurry may be introduced as a wide angle spray 68 as shown in FIG. 4. The liquid introduction means may be easily constructed of readily available standard plumbing pipe and fittings. In the exemplary embodiment 10, shown in FIGS. 1 and 4, a hose 70 connects distribution manifold 72 to a liquid, e.g. water, source (not shown) that can be controlled and regulated to meter the flow rate of the liquid. A flow rate of 60 gpm at 60 to 80 psi is adequate. The manifold 72, here made out of iron pipe and fittings, is shown supplying the water to nozzles 76 which produce a wide angle spray 68 of approximately 100°. One end of each length of flexible tubing 74 is connected at regular intervals along the length of both sides of manifold 72 by appropriate fittings 80. The other end of each length of flexible tubing 74 is connected to a nozzle 76 which is inserted into the second tubular housing assembly 44. The overlapping spray 68 pattern is achieved by positioning the nozzles 76 such that they are fairly high up the sides of the second tubular housing assembly 44 and in matched opposed pairs.

The second conveyor screw assembly 56 can be rotated by any suitable power source, here a hydraulic motor 64, shown coupled to common shaft 62 by a belt 84 and pulleys 86 and 88. The rate of rotation of second conveyor screw assembly 56 should be variable to allow control of the rate of movement and mixing of the cementitious and liquid material. A hydraulic motor 64 of approximately 5 horsepower rotating at approximately 457 rpm (slightly more than twice the rpm of motor 36) has been found adequate. Thus, due to either higher speed or more aggressive screw configuration, or both, the second conveyor screw assembly 56 agitates the mixture to a much greater degree than does the first conveyor screw assembly 28. As explained previously, it is desirable that the rates of rotation of both the first conveyor screw assembly 28 and second conveyor screw assembly 56 be independently controllable and variable, and that the flow rate of liquid be meterable. By altering these variables relative to each other, the quality and quantity of the flowable slurry may be controlled.

There is no one standard "final product," and some final products may require the addition of additional chemicals to create the needed properties. If the chemicals are in liquid form they may be easily added through the liquid introduction means.

Figure 5:
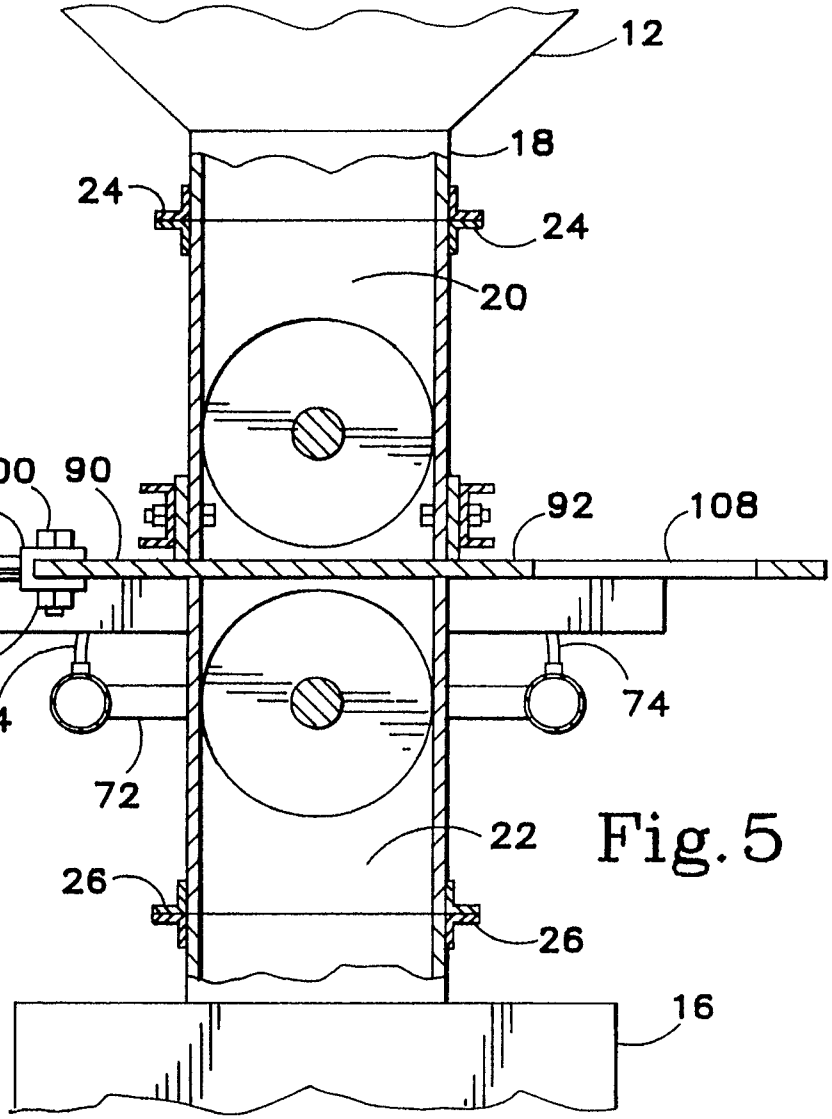
FIG. 5 is a cross-sectional view taken along lines 5-5 of FIG. 1.

The exemplary apparatus 10 also includes a selectively openable and closable bypass gate 90 shown in its normally closed position in FIG. 5. The bypass gate 90 comprises a plate 92 positioned in-line with conveyor inlet 20 and conveyor outlet 22. When the bypass gate 90 is in its open position the dry cementitious material that enters conveyor inlet 20 flows from the measuring device 12 into the final product mixing chamber 16 without being moved by the first conveyor screw assembly 28 or second conveyor screw assembly 56. The bypass gate 90 can be opened in the event of an emergency or if a particular final product requires the addition of dry cementitious material or other material directly into the final product mixing chamber 16. One end of a threaded rod 94 is attached to the plate 92 by a shackle 96, nut 98 and bolt 100. The other end of threaded rod 94 passes through a hole in bracket 102. In FIG. 5, nuts 104 and 106 are shown threaded on rod 94 such that movement of the plate 92 is prevented and bypass gate 90 is closed. To open bypass gate 90 so that the opening 108 in plate 92 is positioned to permit the flow of dry material, nut 104 may be rotated inward and threaded rod 94 may be pulled outward until the opening 108 in plate 92 is positioned as desired. Nut 106 may then be threaded inward until it seats against bracket 102. The bypass gate 90 can thus be adjusted to any position between fully opened and fully closed. The bypass gate 90 shown in FIGS. 2 and 5 is manually operated. It is to be understood that the design could easily be modified to be automatically actuated and operated by pneumatic, hydraulic, or electric motors, or other means.

Depending upon the particular properties of the materials being used, it may be desirable to have a liner or a coating on the inside of the first tubular housing assembly 30 and/or second tubular housing assembly 44 for friction and wear prevention.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An apparatus for mixing cementitious material, liquid, and aggregate material together, including:

(a) a cementitious material measuring device having a material outlet;

(b) a screw conveyor having a conveyor screw assembly enclosed within a tubular housing assembly, said tubular housing assembly having a conveyor inlet located in-line with said material outlet to receive a quantity of said cementitious material from said measuring device, said conveyor screw assembly being capable of moving said cementitious material from said conveyor inlet toward a conveyor outlet in said tubular housing assembly located in-line with both said material outlet and said conveyor inlet;

(c) liquid introduction means located in said tubular housing assembly between said conveyor inlet and said conveyor outlet for depositing a quantity of a liquid into said cementitious material as said cementitious material is being moved from said conveyor inlet toward said conveyor outlet so that said liquid and said cementitious material are agitated and mixed together by movement of said conveyor screw assembly, forming a flowable slurry as said conveyor screw assembly moves said cementitious material and said liquid toward said conveyor outlet;

(d) final product mixing chamber means in receiving relationship to said conveyor outlet for receiving a quantity of said flowable slurry emanating from said conveyor outlet and for mixing said slurry with a measured quantity of aggregate material; and (e) a selectively openable and closable bypass gate interposed in-line between said conveyor inlet and said conveyor outlet to permit said cementitious material to flow from said measuring device into said final product mixing chamber means without being moved by said conveyor screw assembly.

2. The apparatus of claim 1 wherein said screw conveyor includes a first conveyor screw assembly and a second conveyor screw assembly within respective first and second tubular housings for moving said cementitious material simultaneously in different directions from said conveyor inlet toward said conveyor outlet.

3. The apparatus of claim 2 wherein said different directions are generally transverse to the in-line alignment direction of said inlet and outlets.

4. The apparatus of claim 1 wherein said conveyor inlet is positioned vertically above said conveyor outlet and said bypass gate is located vertically therebetween.

5. The apparatus of claim 1 wherein one portion of said conveyer screw assembly includes means for imparting a higher degree of agitation to said cementitious material than does another portion of said conveyor screw assembly.

6. An apparatus for mixing cementitious material, liquid, and aggregate material together, including:

(a) a cementitious material measuring device;

(b) a screw conveyor including:

(i) a first tubular housing enclosing a first conveyor screw assembly, said first tubular housing having an inlet in receiving relationship to said measuring device for receiving a quantity of said cementitious material from said measuring device and having first and second outlets, said conveyor screw assembly having different portions for simultaneously moving said cementitious material away from said inlet in diverging directions toward said first and second outlets, and (ii) a second tubular housing, substantially parallel to said first tubular housing, enclosing a second conveyor screw assembly, said second tubular housing having spaced first and second inlets connected to said first and second outlets of said first tubular housing and having a further outlet, said second conveyor screw assembly having different portions for simultaneously moving said cementitious material from said first and second inlets in converging directions toward said further outlet;

(c) liquid introduction means located in said second tubular housing for depositing a quantity of a liquid into said cementitious material as said cementitious material is being moved toward said further outlet so that said liquid and said cementitious material are agitated and mixed together by movement of said second conveyor screw assembly, forming a flowable slurry as said second conveyor screw assembly moves said cementitious material and said liquid toward said further outlet; and (d) final product mixing chamber means in receiving relationship to said further outlet for receiving a quantity of said flowable slurry emanating from said further outlet and for mixing said slurry with a measured quantity of aggregate material.

7. The apparatus of claim 6 wherein said second conveyor screw assembly includes means for imparting a higher degree of agitation to said cementitious material than does said first conveyor screw assembly.

8. The apparatus of claim 6, further including a selectively openable and closable bypass gate interposed between said first tubular housing and said second tubular housing in such a manner as to allow said cementitious material to flow from said measuring device into said final product-mixing chamber means without being moved by said first and second conveyor screw assemblies.

* * * * *